United States Patent [19]

Leppälä

[11] Patent Number: 4,558,630

[45] Date of Patent: Dec. 17, 1985

[54] HYDRAULIC MECHANISM WITH ELASTICALLY BACKED PISTON PARTS AND COOPERATING VALVE MEANS

[75] Inventor: Matti Leppälä, Pirkkala, Finland

[73] Assignee: Oy Tampella Ab, Finland

[21] Appl. No.: 656,402

[22] PCT Filed: May 28, 1981

[86] PCT No.: PCT/FI81/00040

§ 371 Date: Jan. 11, 1982

§ 102(e) Date: Jan. 11, 1982

[87] PCT Pub. No.: WO81/03527

PCT Pub. Date: Dec. 10, 1981

Related U.S. Application Data

[63] Continuation of Ser. No. 339,445, Jan. 11, 1982, abandoned.

[30] Foreign Application Priority Data

Jun. 5, 1980 [FI] Finland ..... 801815

[51] Int. Cl.[4] ..... F15B 11/08

[52] U.S. Cl. ..... 91/420; 92/85 R; 92/250

[58] Field of Search ..... 92/85 R, 250, 249, 255; 91/420

[56] References Cited

U.S. PATENT DOCUMENTS

| | | | |
|---|---|---|---|
| 1,358,628 | 11/1920 | Fisher | 92/250 |
| 1,481,011 | 1/1924 | Joyce | 92/174 |
| 1,508,264 | 9/1924 | Armentrout | 92/250 |
| 2,765,622 | 11/1956 | Hill et al. | 60/433 |
| 2,958,445 | 11/1960 | Jesse | 92/250 |
| 3,382,772 | 5/1968 | Kampert et al. | 92/85 R |
| 3,872,670 | 3/1975 | Dezelan et al. | 60/469 |
| 3,908,515 | 9/1975 | Johnson | 91/420 |
| 3,908,687 | 9/1975 | Wood | 137/106 |
| 3,974,742 | 8/1976 | Johnson | 91/443 |
| 4,192,338 | 3/1980 | Gerulis | 137/106 |
| 4,341,149 | 7/1982 | Dezelan | 91/420 |

*Primary Examiner*—William R. Cline
*Assistant Examiner*—Randolph A. Smith
*Attorney, Agent, or Firm*—Hill, Van Santen, Steadman & Simpson

[57] ABSTRACT

A hydraulic piston cylinder device comprising a cylinder, a piston dividing the cylinder into two cylinder spaces (A and B), and valve members between the cylinder spaces and respective pressure medium pipes. The problem is to achieve a hydraulic piston cylinder device in which the pressure or tractive force of the cylinder is maintained even if the external pressure led into the cylinder would stop. To solve this problem, an elastic material is interposed between two piston parts, and is elastically compressible by the external pressure applied to the cylinder; and the valve members are coupled to each other so that when one of the valve members is closed the other cannot be closed.

12 Claims, 1 Drawing Figure

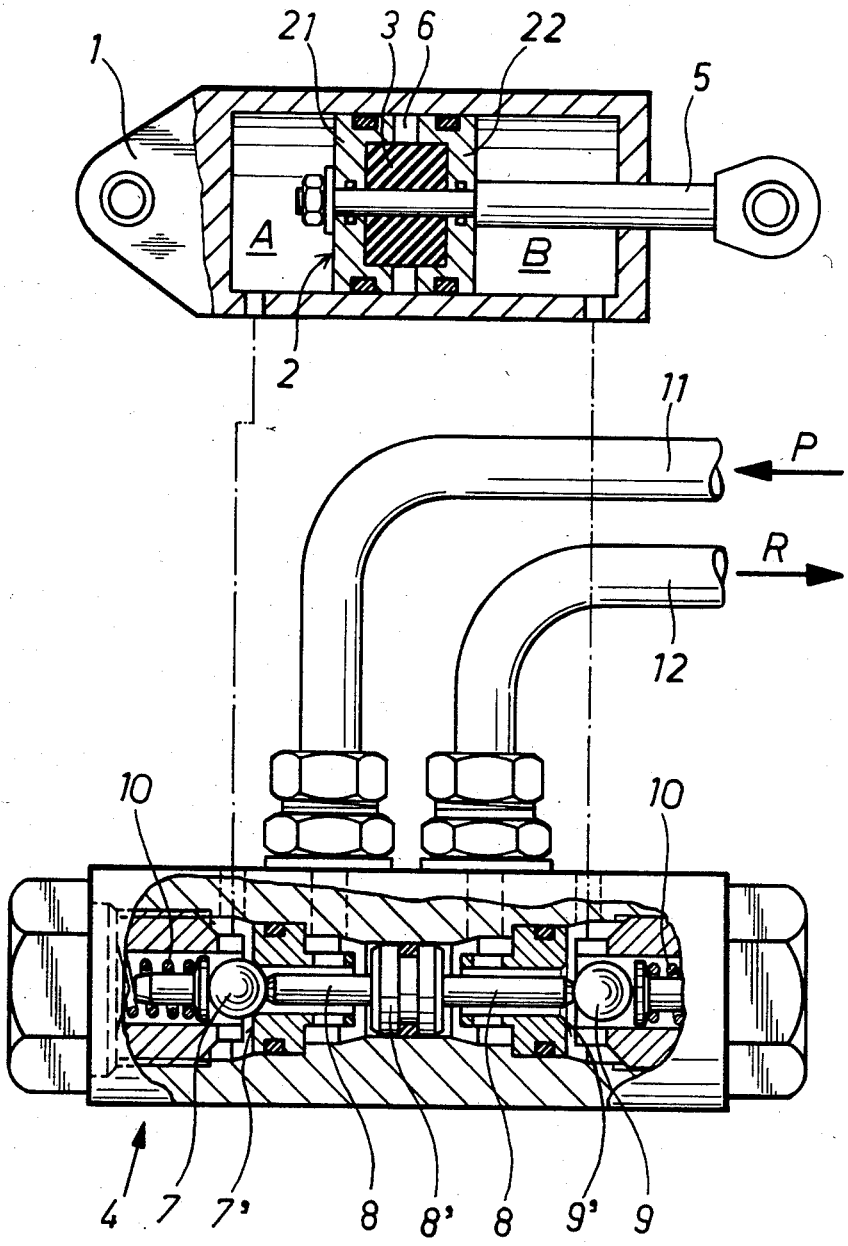
1
21
3
6
22
5
A
B
2
11
P
R
12
10
10
4
7
7'
8
8'
8
9'
9

HYDRAULIC MECHANISM WITH ELASTICALLY BACKED PISTON PARTS AND COOPERATING VALVE MEANS

CROSS-REFERENCE TO RELATED APPLICATION

The present application is a continuation of my prior application U.S. Ser. No. 339,445, filed Jan. 11, 1982, now abandoned.

BACKGROUND OF THE PRESENT INVENTION

This invention relates to a hydraulic piston cylinder device comprising a cylinder, a piston dividing the cylinder into two cylinder spaces, and valve elements between the cylinder spaces and the respective pipes for actuation by a pressure medium.

When this kind of piston cylinder device is being used and the external actuating pressure stops, both valve elements are closed by springs whereby the piston cannot be moved by any external force in either direction because liquid cannot escape from either of the cylinder spaces. It would be sometimes necessary, however, that the pressing or tractive force of the cylinder is maintained even when the external actuating pressure is no longer present. For this purpose it is known to use a pressure accumulator in the hydraulic system. In most cases a separate pressure accumulator connected with hoses is sufficient, but sometimes such accumulator does not provide the required reliability. For example breaking of the hose between the piston cylinder and the accumulator stops the function of the accumulator. There are some events where such uncertain factor cannot be allowed, e.g.:

A retaining centralizer of the drill rod whereby the pressure accumulator prevents the dropping of drill rods into the hole if the external working pressure stops for some reason, Different kinds of support devices, for instance the top supports of wagon drills, Some brake systems.

SUMMARY OF THE INVENTION

The object of the present invention is to provide an improved hydraulic piston cylinder device and such cooperation of valve elements incorporated therewith, that the above-mentioned uncertain factor is eliminated.

This object is achieved through the present invention by the cooperation of piston parts having elastic means that is elastically compressible by means of the pressure of the cylinder and the valve elements which are coupled so that when one of them is closed, the other cannot be closed. If under these conditions the movement of the piston is stopped by an external obstacle before the piston has reached the end surface of the cylinder, the elastic means of the piston is elastically compressed, whereby it absorbs pressure energy. When the external actuating pressure stops and the valve member prevents the escape of pressure from the corresponding cylinder space, there prevails in the cylinder space the pressure caused by the compressible elastic means of the piston. The pressure exerts upon the piston rod a force which has the same direction as the force caused by the external actuating pressure before stopping. To make this force effective, it is necessary that the pressure can escape from the cylinder space on the other side of the piston. This is facilitated by the above-mentioned coupling of the valve elements, allowing only one of the valve members to be closed at a time.

One embodiment of the invention will be described in the following with reference to the accompanying drawing.

BRIEF DESCRIPTION OF THE DRAWING

The single FIGURE is a somewhat diagrammatic illustration which shows a partial crosscut of a piston cylinder device according to the invention, and of valve elements incorporated with it.

DETAILED DESCRIPTION

The piston cylinder device comprises a cylinder 1 which is divided by a piston 2 into two cylinder spaces A and B. The piston 2 is divided in the axial direction into two successive parts 21 and 22 which are separated by a space 6 and between which there is elastic material 3, e.g. rubber, plastic, a steel spring, or the like. The piston rod 5 is connected to the part 22, while the other part 21 is movable in relation thereto within the limits of the space 6 against the elastic material 3. The piston is moved to and fro inside the cylinder by means of pressure liquid which is fed by pipes 11 and 12 via a pilot controlled non-return valve 4. The pilot controlled non-return valve 4 comprises a movable poppet 8 in the middle of which there is piston 8' to move the poppet 8 according to which side of the piston 8' is effected by pressure. The ends of the poppet 8 cooperate with balls 7 and 9 acting as valve elements which are pressed by springs 10 against valve seats 7' and 9' to close the valves, if the pressure or the poppet 8 is not pushing the ball 7 or 9 apart from the valve seat 7' or 9'. According to the invention the length of the poppet 8 relative to the distance between the valve seats 7', 9' is such that only one ball, either 7 or 9, at a time can close the flow between the respective cylinder spaces A and B and the pipes 11 and 12.

The device functions as follows. For example, when pressure liquid is fed into pipe 11, the piston 8' moves the poppet 8 to the right whereby ball 9 moves apart from valve seat 9' and the return channel from cylinder space B into pipe 12 is opened. At the same time pressure has caused ball 7 to move apart from valve seat 7', whereby pressure has free access into cylinder space A, and moves the piston 2 to the right until the movement is stopped by an external obstacle (i.e. an external force). Thereby the elastic element 3 is compressed within the space 6, whereby it absorbs pressure energy. When the external pressure affecting pipe 11 stops, ball 7 of the pilot controlled non-return valve 4 is pressed against valve seat 7' thus preventing the escape of pressure from cylinder space A, whereby the back pressure caused by the elastic element 3 remains in the cylinder space A. This back pressure affects the piston 2 and the piston rod 5 with a force which is parallel to the force which was caused by the external pressure inside pipe 11 before this pressure stopped. Since the spring 10 and the back pressure in cylinder space A keep ball 7 closed, the extended poppet 8 prevents the closing of ball 9 (situation shown in the drawing), whereby the flow from cylinder space B into pipe 12 is free. Thereby the pressure energy stored in the elastic element 3 can produce a force parallel to the piston rod 5. An exactly similar function in reversed direction is caused by leading pressure into the pilot controlled non-return valve 4 through pipe 12.

What is claimed is:

1. A hydraulic mechanism comprising in combination:

(a) a cylinder having a piston rod adapted to be connected to a load;

(b) a double acting piston within the cylinder, with the cylinder having first and second chambers at respective opposite sides of the piston adapted to be alternately connected to pressurized fluid or vented for controlling movement of the piston;

(c) said piston having elastic means which is elastically compressible due to fluid pressure in one chamber of the cylinder;

(d) first and second valves respectively connected to the first and second chambers for controlling the flow of fluid from the respective chambers in the absence of pressurized fluid being supplied to said chambers, a back pressure in one of the chambers forcing the one valve connected to the one chamber to a closed position; and (e) valve controlling means operating such that with a back pressure in one of the chambers and with the one valve connected with the one chamber forced to closed position, the other valve cannot be closed;

(f) the elastic means of said piston being elastically compressed during supply of pressurized fluid to one chamber of the cylinder when the piston rod is subjected to an external force holding it against movement in one axial direction, and said elastic means then producing a back pressure in said one chamber of said cylinder in the absence of pressurized fluid being supplied to said chambers so that the one valve is forced to closed position; and (g) said valve controlling means, with a back pressure in the one chamber and with the one valve forced to closed position, requiring the other valve to be in open position, the position of the piston being maintained due to pressure of fluid locked in said one chamber of said cylinder.

2. A hydraulic mechanism in accordance with claim 1, with said piston comprising first and second piston parts having a space therebetween, said elastic means comprising elastic material in said space.

3. A hydraulic mechanism in accordance with claim 1, with each one of the first and second valves being closed by movement in a direction toward the other of said valves, said valve controlling means being in the form of a rod pushing the other valve to open position when the one valve is closed.

4. A hydraulic mechanism in accordance with claim 3, with said valve controlling means comprising a valve piston connected to said rod and responsive to the supply of pressurized fluid to one chamber to require the rod to be positioned such that the other valve connected to the other chamber cannot be closed.

5. A hydraulic mechanism comprising in combination:

(a) a cylinder having a piston rod adapted to be connected to a load;

(b) a double acting piston within the cylinder with the cylinder having first and second chambers at respective opposite sides of the piston;

(c) said piston having first and second piston part means exposed to fluid in the first and second chambers of the cylinder, respectively, and further comprising elastic means backing one of said first and second piston part means to accommodate movement thereof relative to the piston rod over a limited distance, the elastic means being elastically compressible by movement of the one of said first and second piston part means relative to the piston rod due to pressurized fluid in the one chamber to which the one of said first and second piston part means is exposed;

(d) first and second valves respectively connected to the first and second chambers of the cylinder for controlling the flow of fluid thereto and adapted to be alternately connected to pressurized fluid or vented for controlling the movement of the piston;

(e) said valves both being open when pressurized fluid is supplied to one of the valves;

(f) one of said valves individually being forced to a closed position when a back pressure is present in the one of said chambers to which the one valve is connected; and (g) coupling means coupling the operation of the one valve with the other such that when a back pressure is present and the one valve is forced to closed position the other valve cannot be closed;

(h) the elastic means of said piston being elastically compressed by movement of the one of said first and second piston part means relative to the piston rod during supply of pressurized fluid to the one chamber of the cylinder when the piston rod is subjected to an external force holding it against movement in one axial direction, and said elastic means then producing a back pressure in said one chamber of said cylinder in the absence of pressurized fluid being supplied to said valves so that the one valve is forced to closed position; and (i) said coupling means requiring that, when the back pressure is present in the one chamber and the one valve is thereby forced to closed position, the other valve be open to vent the other chamber, said elastic means urging the piston rod in the one axial direction due to fluid being locked in the one chamber when the one valve is closed as result of said back pressure.

6. A hydraulic mechanism in accordance with claim 5, with said first and second piston part means comprising respective separate piston parts having a space therebetween, said elastic means comprising elastic material in said space for axial compression when either piston part moves toward the other.

7. A hydraulic mechanism in accordance with claim 5, with one of the first and second valves being closed by movement in a direction toward the other of said valves, said coupling means being in the form of a rod requiring the other valve to be open when the one valve is closed.

8. A hydraulic mechanism in accordance with claim 7, with said first and second valves being in the form of balls, said coupling means comprising a valve piston connected to said rod and responsive to the supply of pressurized fluid to the one valve to require the rod to be positioned such that the other valve cannot be closed.

9. A hydraulic mechanism comprising in combination:

(a) a cylinder having a piston rod adapted to be connected to a load;

(b) a double acting piston within the cylinder, with the cylinder having first and second chambers at respective opposite sides of the piston;

(c) said piston comprising first and second piston parts exposed to fluid in the first and second chambers of the cylinder, respectively, and further comprising elastic means backing the first and second piston parts to accommodate axial shifting thereof relative to the piston rod over a limited axial distance, the elastic means being axially elastically compressible by movement of the first piston part relative to the piston rod in a first axial direction, and being axially elastically compressible by movement of the second piston part relative to the piston rod in a second axial direction opposite to said first axial direction;

(d) first and second valves respectively connected to the first and second chambers of the cylinder for controlling the flow of fluid thereto and adapted to be alternately connected to pressurized fluid or vented for controlling the movement of the piston;

(e) and coupling means between said valves for coupling the operation of one of said valves with the other;

(f) said valves both being open when pressurized fluid is supplied to one of the valves;

(g) said valves individually being forced to a closed position when a back pressure is present in the respective chamber of the cylinder to which they are connected;

(h) the elastic means of said piston being axially elastically compressed by movement of one of the first and second piston parts relative to the piston rod in one axial direction during supply of pressurized fluid to the one chamber of the cylinder to which the one piston part is exposed when the piston rod is subjected to an external force holding it against movement in the one axial direction, and said elastic means then producing a back pressure in the one chamber of said cylinder in the absence of pressurized fluid being supplied to the valves so that the one valve connected to the one chamber is forced to closed position; and (i) said coupling means operating such that when the back pressure is present in the one chamber and the one valve is forced to closed position, the other valve is open to vent the other chamber, said back pressure urging the piston rod in the one axial direction.

10. A hydraulic mechanism in accordance with claim 9, with said first and second piston parts having a space therebetween, said elastic means comprising elastic material in said space.

11. A hydraulic mechanism in accordance with claim 9, with each one of the first and second valves being closed by movement in a direction toward the other of said valves, said coupling means being in the form of a rod requiring the other valve to be open when the one valve is closed.

12. A hydraulic mechanism in accordance with claim 11, with said first and second valves being in the form of balls, said coupling means being provided with a valve piston responsive to the supply of pressurized fluid on either side of said valve piston to tend to move said rod to require one of said valves to be open.

* * * * *